United States Patent [19]

Terauchi et al.

[11] 4,435,136

[45] Mar. 6, 1984

[54] ORBITING PISTON TYPE FLUID DISPLACEMENT APPARATUS WITH SHAFT BEARING AND SEAL MECHANISMS

[75] Inventors: Kiyoshi Terauchi, Isesaki; Seiichi Sakamoto, Gunma, both of Japan

[73] Assignee: Sanden Corporation, Gunma, Japan

[21] Appl. No.: 260,756

[22] Filed: May 5, 1981

[30] Foreign Application Priority Data

May 7, 1980 [JP] Japan ..... 55-59460

[51] Int. Cl.[3] ..... F01C 1/02; F01C 19/12; F01C 21/02

[52] U.S. Cl. ..... 418/55; 418/104; 308/187.1

[58] Field of Search ..... 418/55, 57, 59, 54, 418/56, 58, 60, 61 R, 61 A, 61 B, 104; 308/187.1, 189 R

[56] References Cited

U.S. PATENT DOCUMENTS

| | | | |
|---|---|---|---|
| 1,431,793 | 10/1922 | Hatcher | 418/60 |
| 2,391,577 | 12/1945 | Larson | 308/187.1 |
| 2,764,101 | 9/1956 | Rand | 418/55 |
| 3,560,119 | 2/1971 | Busch et al. | 418/55 |
| 3,874,827 | 4/1975 | Young | 418/55 |
| 3,884,599 | 5/1975 | Young et al. | 418/55 |
| 4,082,484 | 4/1978 | McCullough | 418/55 |
| 4,087,215 | 5/1978 | Miller | 418/61 B |
| 4,129,405 | 12/1978 | McCullough | 418/55 |
| 4,178,143 | 12/1979 | Thelen et al. | 418/55 |
| 4,199,308 | 4/1980 | McCullough | 418/55 |
| 4,216,661 | 8/1980 | Tojo et al. | 418/55 |

*Primary Examiner*—John J. Vrablik

*Attorney, Agent, or Firm*—Schuyler, Banner, Birch, McKie & Beckett

[57] ABSTRACT

A fluid displacement apparatus, in particular, a compressor unit, is disclosed. The apparatus includes a housing having a front end plate member and a fixed member and an orbiting piston member. The members interfit to make a plurality of line contacts to define at least one pair of sealed off fluid pocket. A driving mechanism, including a drive shaft is disposed within the housing and is connected to the orbiting piston member to effect the orbital motion of the orbiting piston member by the rotation of the drive shaft. The front end plate member is comprised of a front end plate portion in which is formed an opening for passage of the drive shaft, and an annular sleeve portion extending from a front end surface of the front end plate portion for surrounding the drive shaft. The drive shaft is rotatably supported by two bearing means which are disposed within the front end plate member. A shaft seal assembly is assembled on the drive shaft within the front end plate member and is placed between the two bearing means. Therefore, the load of the two bearing means is reduced without increasing the length of the housing.

8 Claims, 9 Drawing Figures

ORBITING PISTON TYPE FLUID DISPLACEMENT APPARATUS WITH SHAFT BEARING AND SEAL MECHANISMS

BACKGROUND OF THE INVENTION

This invention relates to a rotary fluid displacement apparatus, more particularly, to a fluid compressor unit or pump unit of the types which utilize an orbiting piston member.

There are several types of fluid displacement apparatus which utilize an orbiting piston or fluid displacing member driven by a Scotch yoke type shaft coupled to an end surface of the piston or member. One apparatus disclosed in U.S. Pat. No. 1,906,142 to John Ekelof, is a rotary machine provided with an annular and eccentricaly movable piston adapted to act within an annular cylinder with a radial transverse wall. One end of the wall of the cylinder is fixedly mounted and the other wall consists of a cover disc connected to the annular piston, which is driven by a crank shaft. Other prior art apparatus of this type are shown in U.S. Pat. No. 801,182 and 3,560,119.

Though the present invention applies to either type of fluid displacement apparatus, i.e., using either an annular piston or a scroll-type piston, the description will be limited to the scroll type compressor. The term piston is used generically to describe a movable member of any suitable configuration in fluid displacement apparatus.

U.S. Pat. No. 801,182 discloses a device including two scroll members each having an end plate and a spiroidal or involute spiral element. These scroll members are maintained angularly and radially offset so that both spiral elements interfit to make a plurality of line contacts between spiral curved surfaces thereby to seal off and define at least one pair of fluid pockets. The relative orbital motion of the two scroll members shifts the line contact along the spiral curved surfaces and, therefore, the fluid pockets change in volume. The volume of the fluid pockets increases or decreases dependant on the direction of the oribital motion. Therefore, the scroll-type apparatus is applicable to compress, expand or pump fluids.

Typically, a drive shaft receives and transmits a rotary driving force from an external power source. The drive shaft is rotatably supported by a bearing means disposed within a housing. In particular, as shown in U.S. Pat. No. 3,874,827, the drive shaft is rotatably supported by the two bearing means disposed within the housing.

Referring to FIG. 9, such shaft supporting constructions will be described. Adrive shaft 13' is formed with a disk portion 15' at its inner end portion and is rotatably supported by a first bearig means 19' disposed within a sleeve 17' projecting from a front end plate 11'. Disk portion 15' is also rotatably supported by a second bearing means 16' disposed within sleeve 17' of housing 10'. A crank pin of drive pin (not shown) axially projects from an end surface of disk portion 15', and is radially offset from the center of drive shaft 13'. The drive pin is connected to an orbiting scroll member for transmitting the orbital motion from the drive shaft 13' to the orbiting scroll member, and the orbiting scroll member is connected to a rotation preventing means, therefore orbiting scroll member is allowed to undergo the orbital motion by the rotation of drive shaft 13'.

In the above described shaft supporting construction, a load Fd, caused by a reaction force to the compression of fluid during the operation of the apparatus, acts on a bearing means 34' which rotatably supports the oribiting scroll member. Therefore, since drive shaft 13' is connected to the bushing 33' through the drive pin, this load Fd is transmitted to the shaft 13' which is rotatably supported by the two bearing means 16', 19' disposed within the sleeve 17' of front end plate 11'. At this time, the load $FB_1$ and $FB_2$ acting on the two bearing means 16' and 19' are given by:

$FB_1 = Fd + FB_2$, since the illustrated upwardly directed force is equal to the sum of the downwardly directed forces; and $FB_2(X_2) = Fd(X_1)$, since these oppositely directed moments are equal.

Therefore, if the distance $X_2$ is made longer, the load $FB_1$ and $FB_2$ acting on the two bearing means would be decreased and thereby the durability of these bearing means would be improved. However, in the general construction of the apparatus, a shaft seal assembly 20' is assembled on the drive shaft 13' within the sleeve 17' of front end plate 11' and placed outwardly of and against the bearing means. Therefore, if the distance $X_2$ is made greater, the total length of apparatus will be increased.

A scroll-type fluid apparatus of this type is suited for use as a refrigerant compressor of an automobile air-conditioner. Generally, the compressor is coupled to a magnetic clutch for transmitting the output of the engine to the drive shaft of the compressor. The magnetic clutch comprises a pulley, magnetic coil, hub and armature plate. The pulley, which is usually rotated by the output of the engine, is rotatably supported by the sleeve through a bearing means disposed on the outer surface of the sleeve, and the magnetic coil is fixed on the outer surface of the sleeve.

The sleeve, which supports the pulley and magnetic coil, extends from an end surface of the housing and is cantilevered, therefore, the sleeve requires mechanical strength. Because tensile force of the belt which connects the pulley and the engine for transmitting the rotary motion is transmitted to the sleeve through the pulley and the bearing means, the thickness of the sleeve has a lower limit so that diameter of the bearing means which supports the pulley cannot be decreased. The outer diameter of compressor unit itself is thereby increased.

SUMMARY OF THE INVENTION

It is a primary object of this invention to provide a fluid displacement apparatus with an improved durability of the bearing means which supports the drive shaft.

It is another object of this invention to provide a fluid displacement apparatus wherein the radial and axial dimensions of the apparatus are inherently reduced.

It is still another object of this invention to provide a fluid displacement apparatus wherein oscillation or motion of the drive shaft off of its intended axis is minimized.

It is yet another object of this invention to provide a fluid displacement apparatus which accomplishes the above described objects, yet is simple in construction and production.

An orbiting piston type fluid displacement apparatus according to this invention includes a housing having a front end plate member, and a fixed member fixedly disposed relative to the housing to accept and cooperate with an orbiting piston to compress or pump fluid. The orbiting piston is driven by a drive shaft which penetrates the front end plate member and is rotatably supported thereby through two axially spaced bearing means, one of which is fitted in the opening of the front end plate and the other is disposed within a sleeve portion and placed axially outside of a hollow seal portion formed in the sleeve portion. A shaft seal assembly is assembled on the drive shaft within the hollow seal portion.

One aspect of the this invention includes a housing having a front end plate member. A fixed scroll member is fixedly disposed relative to the housing and has an end surface from which a first wrap means extends into the interior of the housing. An orbiting scroll member has an end plate means from which a second wrap means extends. The first and second wrap means interfit at an angularly offset to make a plurality of line contacts to define at least one pair of sealed off fluid pockets.

A driving means including a drive shaft which penetrates the front end plate member and is rotatably supported thereby, effects the orbital motion of the orbiting scroll member by the rotation of the drive shaft while the rotation of the orbiting scroll member is prevented, whereby the fluid pockets changes volume by the orbital motion of the orbital scroll member.

The front end plate member comprises a front end plate portion in which is formed an opening for penetration of the drive shaft, and an annular sleeve portion which extends from a front end surface of the front end plate portion for surrounding the drive shaft. A shaft seal assembly is assembled on the drive shaft within the front end plate member.

The drive shaft is rotatably supported by the housing through two bearing means. One of the bearing means is disposed within the housing, and the other of bearing means is disposed within the sleeve and is placed axially outward of the shaft seal assembly.

Further objects, features and other aspects of this invention will be understood from the following detailed description of the preferred embodiments of this invention referring to the annexed drawings.

DETAILED DESCRIPTION OF THE PREFERRED EMBODIMENT

Figure 1:
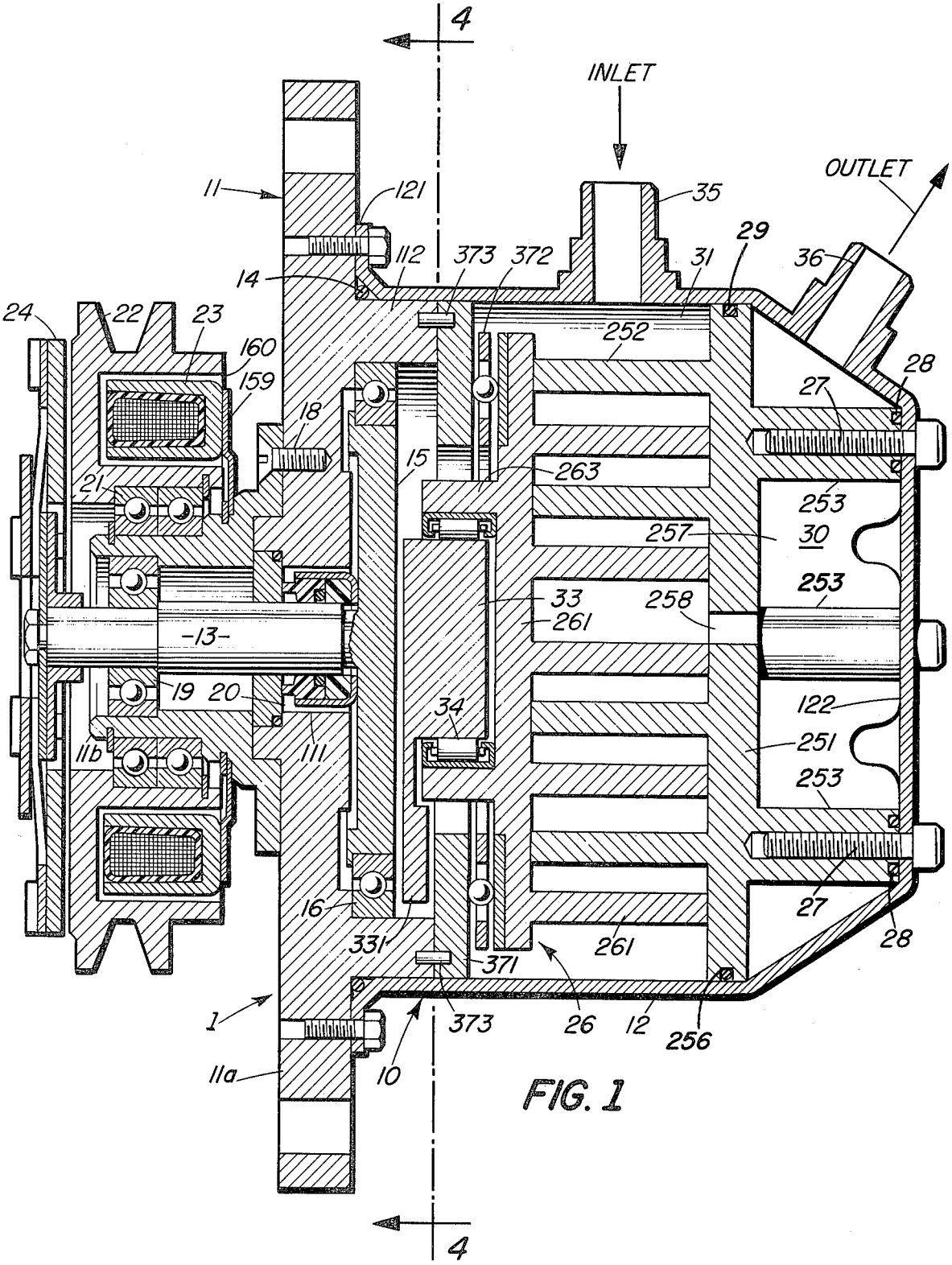
FIG. 1 is a vertical sectional view of a compressor unit type of fluid displacement apparatus according to one embodiment of this invention.

Referring to FIG. 1, a fluid displacement apparatus in accordance with the present invention, in particular a scroll-type refrigerant compressor unit 1 of an embodiment of the present invention is shown. The unit 1 includes a compressor housing 10 comprising a front end plate member 11, and a cup shaped portion 12 which is formed by press working of steel plate or aluminum die castings and is disposed to an end surface of front end plate member 11.

In this embodiment as shown in FIG. 1, front end plate member 11 comprises a front end plate portion 11*a* which is, for example, formed of aluminum or aluminum alloy, and an annular sleeve portion 11*b* projecting from the front end surface of front end plate portion 11*a*. An opening 111 is formed in center of front end plate portion 11*a* for the penetration or passage of a drive shaft 13. An annular projection 112, which projects concentric with and radially spaced from opening 111, is formed in the rear end surface of front end plate portion 11*a* facing to the cup shaped portion 12. Cup shaped portion 12 has a flange portion 121 which extends radially outward along an opening portion thereof. An inner surface of the opening portion of cup shaped portion 12 is fitted to an outer peripheral surface of annular projection 112, and end surface of flange portion 121 is fitted to the rear end surface of front end plate portion 11*a* and fixed to front end plate portion 11*a* by a fastening means, for example, bolt-nut means. The opening portion of cup shaped portion 12 is thereby covered by front end plate portion 11*a*. A sealing member, such as an O-ring 14 is placed between front end plate portion 11*a* and flange portion 121 of cup shaped portion 12 to thereby form a seal along the mating surfaces of the front end plate portion 11*a* and the cup shaped portion 12.

Sleeve portion 11*b* is formed of steel and is separate from front end plate portion 11*a*. Therefore, sleeve portion 11*b* is fixed to the front end surface of front end plate portion 11*a* by screws, one of which is shown as a screw 18. A hollow space of sleeve portion 11*b* forms a continuation of opening 111 of front end plate portion 11*a*. A shaft seal assembly 20 is assembled on drive shaft 13 within opening of front end plate portion 11*a*. But it is not necessary for the shaft seal assembly 20 to be disposed within the opening of end plate portion 11*a*, it may be disposed within the hollow space of sleeve portion 11*b*.

A pulley 22 is rotatably supported by a bearing means 21. The bearing means 21 is disposed on the outer surface of sleeve portion 11*b*. An electromagnetic annular coil 23 is fixed to the outer surface of sleeve portion 11*b* by a supporting plate 159 and is received in an annular cavity 160 of pulley 22. An armature plate 24 is elastically supported on the outer end of drive shaft 13 which extends from sleeve portion 11*b*. A magnetic clutch comprising pulley 22, magnetic coil 23 and armature plate 24 is thereby formed. Thus, drive shaft 13 is driven by an external drive power source, for example, a motor of a vehicle, through a rotation force transmitting means such as the magnetic clutch.

A fixed scroll member 25, an orbiting scroll member 26, a driving mechanism of orbiting scroll member 26 and a rotation preventing mechanism of orbiting scroll member 26 are disposed in an inner chamber of cup shaped portion 12. The inner chamber is formed between an inner surface of cup shaped portion 12 and front end plate 11*a*.

Figure 2:
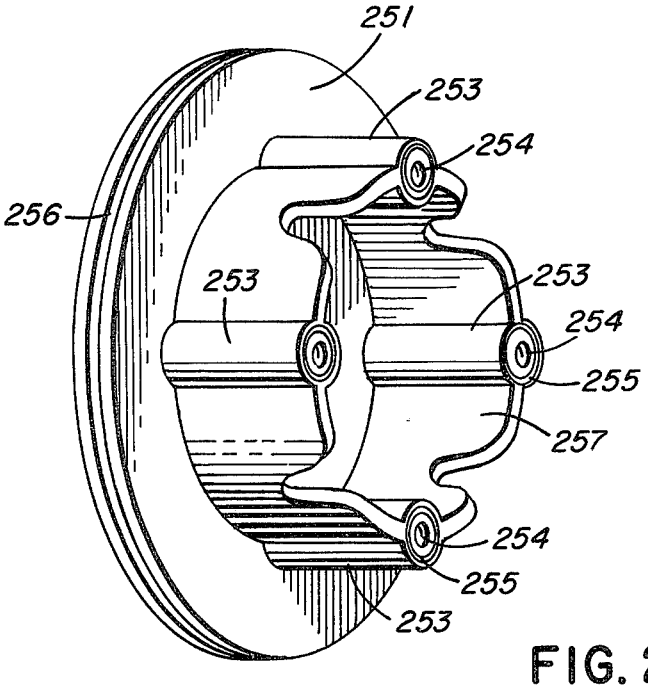
FIG. 2 is a perspective view of the fixed scroll member in the embodiment of FIG. 1.

Fixed scroll member 25 includes a circular end plate 251 and a wrap means or spiral elements 252 affixed to or extending from one major side surface of circular plate 251. Circular plate 251 of fixed scroll member 25 is formed with a plurality of legs 253 axially projecting from a major end surface opposite to the side of the plate 251 from which spiral elements 252 extend or are affixed. In the embodiment of this invention, as shown in FIG. 2, a wall portion 257 is formed in the area between each leg 253 for reinforcing the legs 253. An end surface of each leg 253 is fitted against the inner surface of a bottom plate portion 122 of cup shaped portion 12 and is fixed to bottom plate portion 122 of cup shaped portion 12 by screws 27 which screw into legs 253 from the outside of bottom plate portion 122. A first seal ring member 28 is disposed between the end surface of each legs 253 and the inner surface of bottom plate portion 122, to thereby prevent leakage along screw 27. Referring to FIG. 2, a tapped hole 254 for receiving screw 27 and an annular groove 255 for receiving seal ring 28 are formed in the end surface of each leg 253. A groove 256 is formed on the outer peripheral surface of circular plate 251 and a second seal ring member 29 is disposed therein to form a seal between the inner surface of cup shaped portion 12 and the outer peripheral portion of circular plate 251. Thus, the inner chamber of cup shaped portion 12 is partitioned into two chambers by circular plate 251, such as a rear chamber 30 and a front chamber 31. Front chamber 31 contains orbiting scroll member 26, driving mechanism, rotation preventing mechanism and spiral element 252 of fixed scroll member 25. Rear chamber 30 contains the plurality of legs 253.

Cup shaped portion 12 is provided with a fluid inlet port 35 and a fluid outlet port 36, which respectively are connected to the front and rear chambers 31, 30. A hole or discharge port 258 is formed through the circular plate 251 at a position near to the center of spiral element 252 and is connected to the fluid pocket of spiral element center and rear chamber 30.

Orbiting scroll member 26 is disposed in front chamber 31. Orbiting scroll member 26 also comprises a circular end plate 261 and a wrap means or spiral element 262 affixed to or extending from one side surface of circular end plate 261. Spiral element 262 and spiral element 252 of fixed scroll member 25 interit at angular offset of 180° and a predetermined radial offset. Fluid pockets are thereby defined between spiral elements 252, 262. Orbiting scroll member 26 is connected to the driving mechanism and to the rotation preventing/-thrust bearing mechanism. These last two mechanisms effect orbital motion of the orbiting scroll member 26 at a circular radius Ro by rotation of drive shaft 13, to thereby compress fluid passing through the compressor unit.

Generally, radius Ro of orbital motion given by:

$$\frac{\text{(pitch of spiral element)} - 2\text{(wall thickness of spiral element)}}{2}$$

Figure 7:
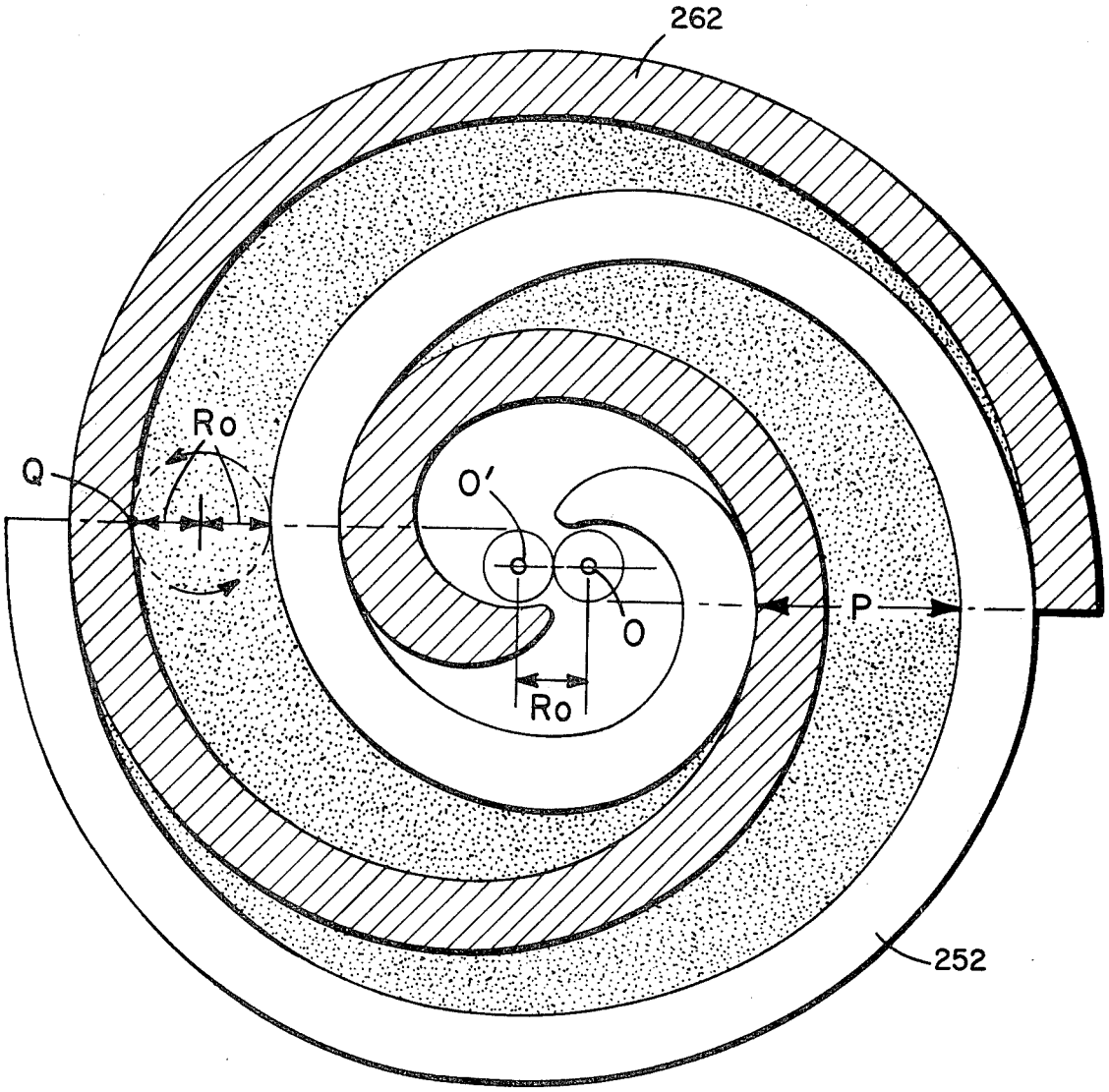
FIG. 7 is a diagrammatic sectional view illustrating the spiral elements of the fixed and orbiting scroll members.
Figure 9:
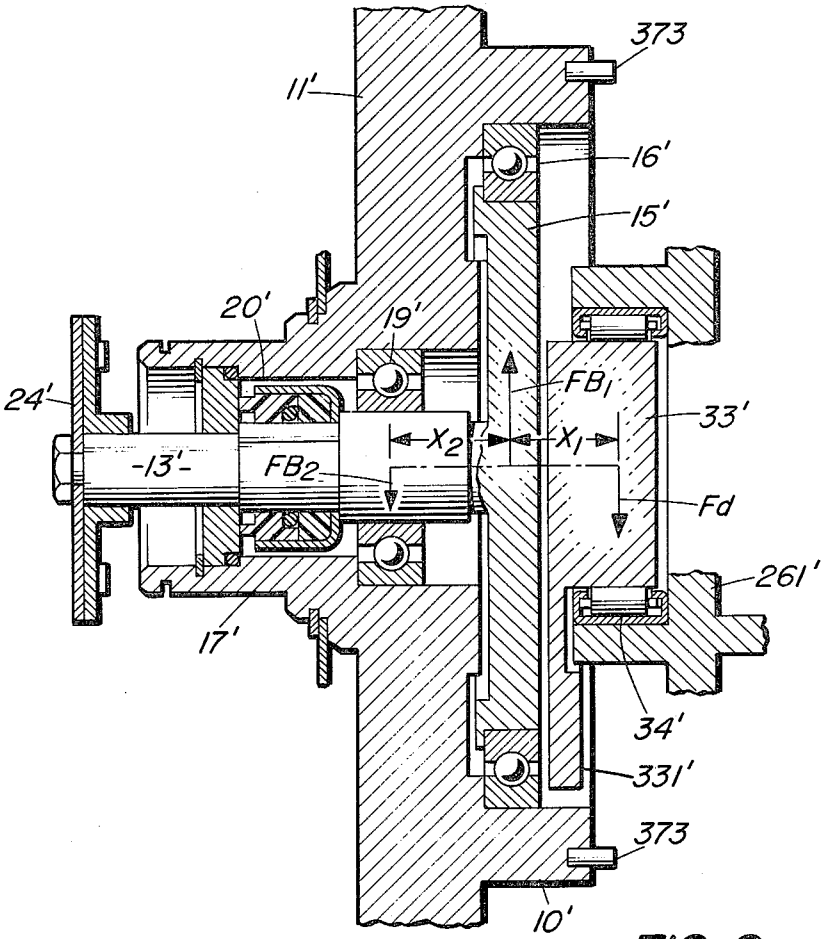
FIG. 9 PRIOR ART
FIG. 9 is a vertical sectional view of a main portion of drive shaft supporting mechanism of the prior art.

As seen in FIG. 7, the pitch (P) of the spiral elements can be defined by $2 \cdot r_g$, where $r_g$ is the involute generating circle radius. The radius of orbital motion Ro is also illustrated in FIG. 7, as a locus of an arbitrary point Q on orbiting scroll member 26. Spiral element 262 is placed radially offset from spiral element 252 of fixed scroll member 25 by the distance Ro. Thereby, orbiting scroll member 26 is allowed to undergo the orbital motion of radius Ro by the rotation of drive shaft 13. As the orbiting scroll member 26 orbits, line contacts between both spiral elements 252 and 262 shift to the center of the spiral elements along the surface of the spiral elements. Fluid pockets defined between spiral elements 252 and 262 move to the center with a consequent reduction of volume, to thereby compress the fluid in the pockets. Fluid inlet port 35 is connected to front chamber 31 and fluid outlet port 36 is connected to rear chamber 30. Therefore, fluid or refrigerant gas, introduced into front chamber 31 from an external fluid circuit through inlet port 35, is taken into fluid pockets formed between both spiral elements 252 and 262 from outer end portion of the both spiral elements. As scroll member 26 orbits, fluid in the fluid pockets is compressed and the compressed fluid is discharged into rear chamber 30 from the fluid pocket at the spiral element center through hole 258, and therefrom, discharged through the outlet port 36 to an external fluid circuit, for example, a cooling circuit.

Figure 3:
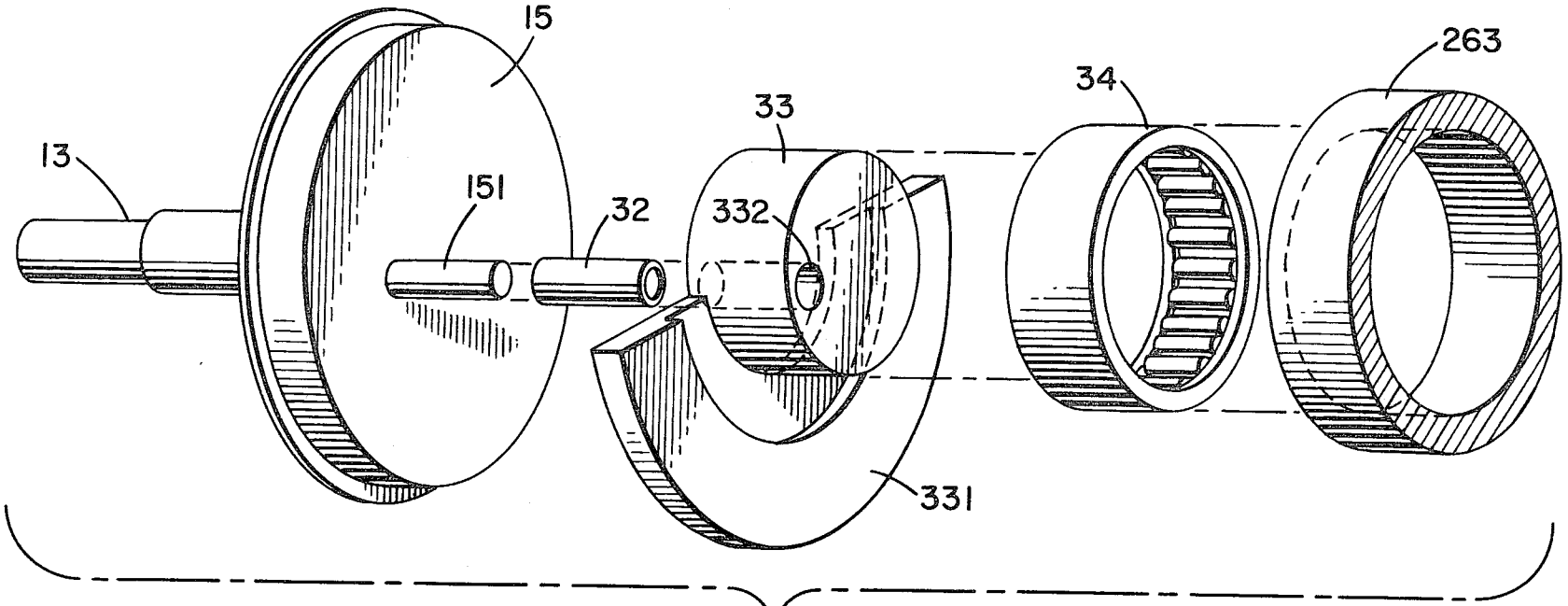
FIG. 3 is an exploded perspective view of the driving mechanism in the embodiment of FIG. 1.

Referring to FIG. 1 and FIG. 3, the driving mechanism of orbiting scroll member 26 will be described. Drive shaft 13 is formed with a disk rotor 15 at its inner end portion and is rotatably supported by sleeve portion 11*b* through bearing means, such as ball bearing 19 which is disposed within sleeve portion 11*b* and placed outwardly of shaft seal assembly 20. Disk rotor 15 is also rotatably supported by front end plate portion 11*a* through bearing means, such as ball bearing 16 disposed in the inner peripheral surface of annular projection 112.

A crank pin or drive pin 151 projects axially from an end surface of disk rotor 15 and, hence, from an end of drive shaft 13, and is radially offset from the center of drive shaft 13. Circular plate 261 of orbiting scroll member 26 is provided with a tubular boss 263 axially projecting from an end surface opposite to the side thereof from which spiral element 262 extends or is affixed. A discoid or short axial bushing 33 is fitted into boss 263, and is rotatably supported therein by bearing means, such as a needle bearing 34. Bushing 33 has a balance weight 331 which is shaped as a portion of a disk or ring and extends radially from bushing 33 along a front surface thereof. An eccentric hole 332 is formed in bushing 33 radially offset from the center of bushing 33. Drive pin 151 is fitted into the eccentrically disposed hole 332 within which a bearing means 32 may be applied. Bushing 33 is therefore driven by the revolution of drive pin 151 and permitted to rotate by needle bearing 34.

Figure 4:
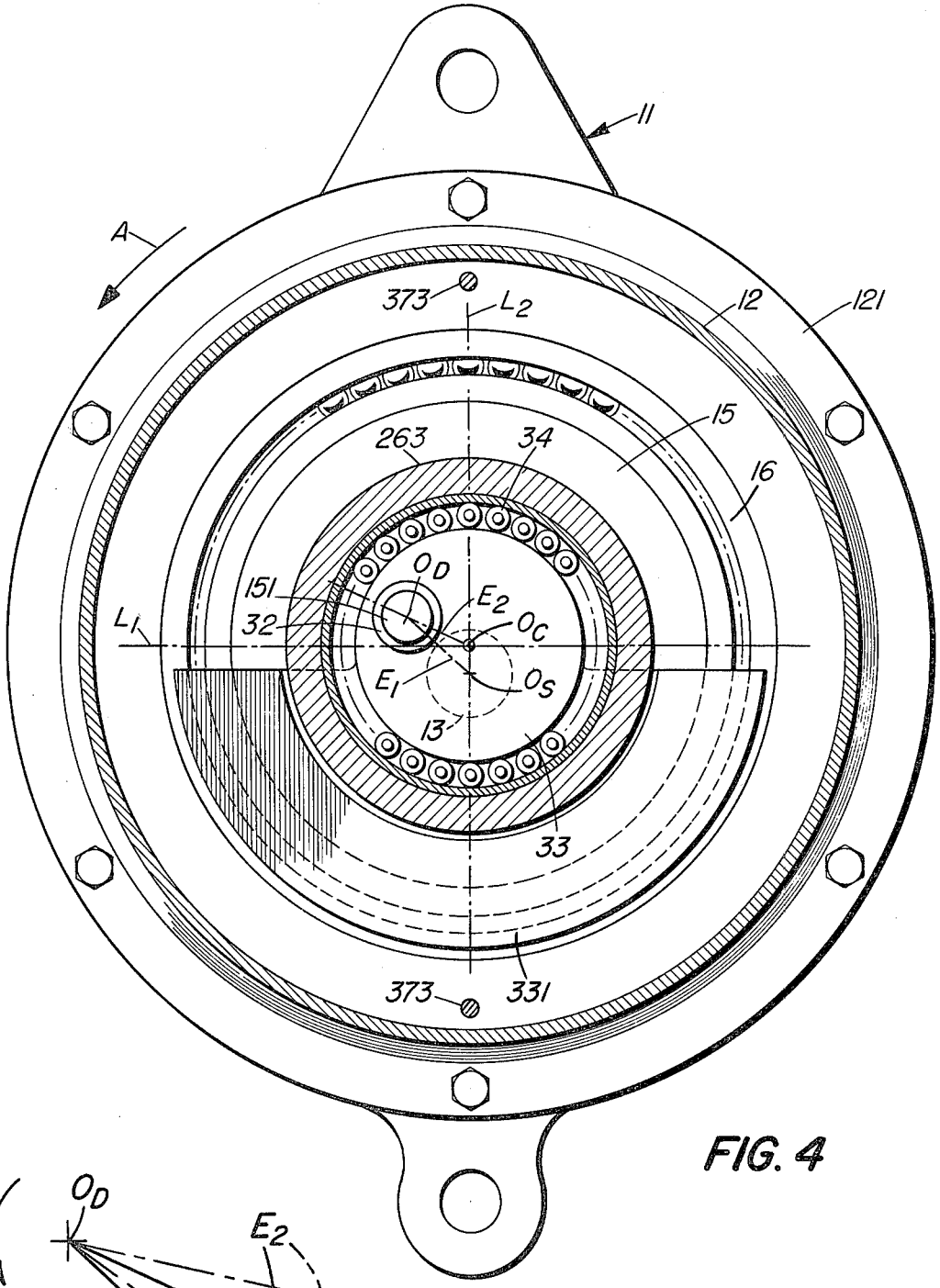
FIG. 4 is a sectional view taken generally along line 4—4 in FIG. 1.

Respective placement of center Os of drive shaft 13, center Oc of bushing 33, and center Od of hole 332 and thus drive pin 151, is shown in FIG. 4. In the position shown in FIG. 4, the distance between Os and Oc is the radius Ro of orbital motion, and when drive pin 151 is placed in eccentric hole 332, center Od of drive pin 151 is placed, with respect to Os, on the needle side of a line L1, which is through Oc and perpendicular to a line L2 through Oc and Os, and also beyond the line through Oc and Os in the direction of rotation A of drive shaft 13.

Figure 5:
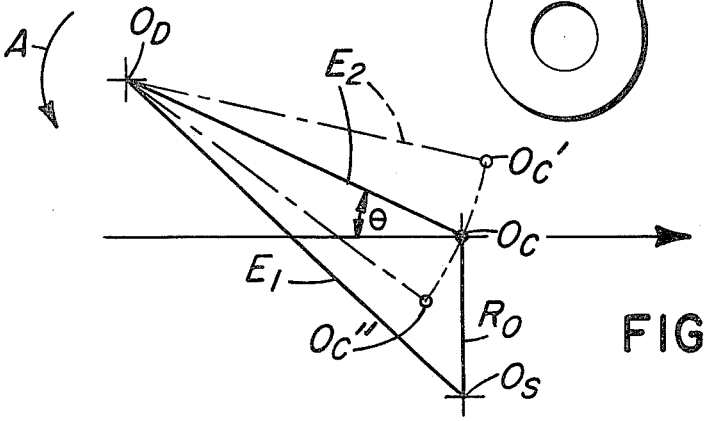
FIG. 5 is an explanatory diagram of the motion of the eccentrical bushing in the embodiment of FIG. 1.

In this construction of the driving mechanism center Oc of bushing 33 is permitted to swing about the center Od of drive pin 151 at a radius E2, as shown in FIG. 5. Such swing motion of center Oc is illustrated as arc Oc'–Oc" in FIG. 5. This permitted swing motion allows the orbiting scroll member 30 to compensate its motion for changes in radius Ro due to wear on the spiral elements 252 and 262 or due to other dimensional inaccuracies of the spiral elements. When drive shaft 13 rotates, drive force is exerted at center Od of drive pin 151 to the left and reaction force of gas compression appears at center Oc of bushing 33 to the right, both forces being parallel to line L1. Therefore, the arm Od–Oc can swing outwardly by creation of the moment generated by the two forces. The spiral element 262 of orbiting scroll member 26 is thereby forced toward spiral element 252 of fixed scroll member 25, and the center of orbiting scroll member 26 orbits with the radius Ro around center Os of drive shaft 13. The rotation of orbiting scroll member 26 is prevented by a rotation preventing/thrust bearing mechanism, described more fully hereinafter, whereby orbiting scroll member 26 orbits while maintaining its angular orientation. The fluid pockets move because of the orbital motion of orbiting scroll member 26, to thereby compress the fluid.

Figure 8:
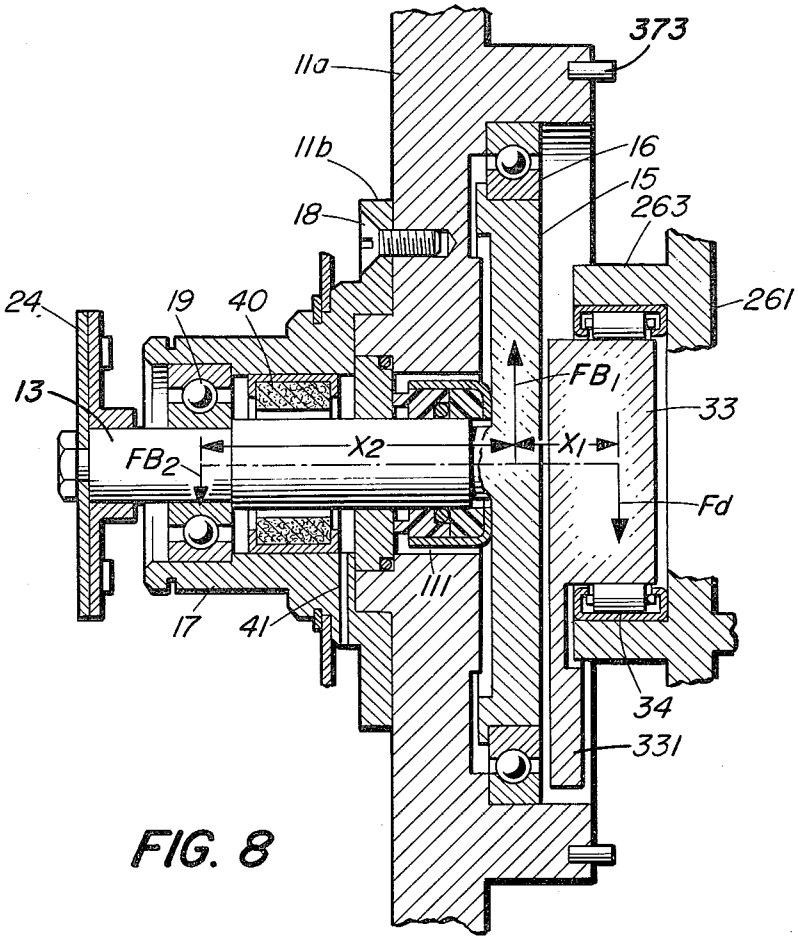
FIG. 8 is a vertical sectional view of a main portion of drive shaft supporting mechanism in the embodiment of FIG. 1.

Drive shaft 13 is rotatably supported by the two bearing means 16, 19 which are axially spaced. One of bearing means 19 is disposed within sleeve portion **11*b* and is placed outwardly of shaft seal assembly 20, as shown in FIG. 8. Therefore, drive shaft 13 is securely supported in a manner to prevent oscillation or motion of the shaft 13 off of its intended axis. The axial distance $X_2$ is made longer without adding to the length of housing 10 because the bearing 19 is disposed outward, rather than inward of the shaft seal assembly 20. This increase of the distance $X_2$ reduces the load acting on the two bearing means. With bearing means 19 placed outwardly of shaft seal assembly 20, bearing means 19 cannot be lubricated by the lubrication oil enclosed in housing 10. Whereby bearing means 19** is comprised of a sealed off and enclosed grease bearing.

Moreover, lubrication oil is enclosed in the housing and may leak into the hollow space of sleeve portion **11*b* through shaft seal assembly 20, it is feared that the leaked oil could have a detrimental influence upon the bearing means 19. Therefore, a felt member 40 is disposed within the hollow space of sleeve portion 11*b* to absorb the leaked oil. Alternatively, a hole 41 is formed through the sleeve portion 11*b* and connects the hollow space of sleeve portion 11*b*** with the exterior of the apparatus for the escape of leaked oil.

Figure 6:
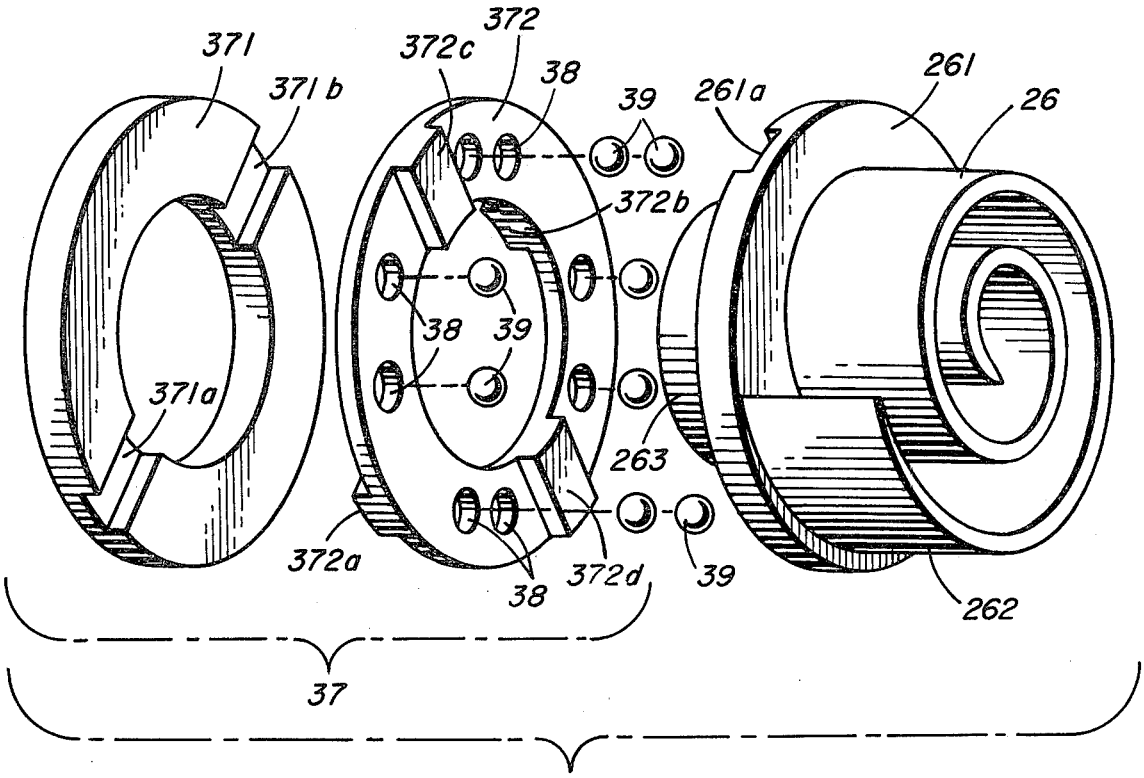
FIG. 6 is an exploded perspective view of a rotation preventing/thrust bearing mechanism in the embodiment of FIG. 1.

Referring to FIG. 6 and FIG. 1, a rotation preventing/thrust bearing means 37 will be described. Rotation preventing/thrust bearing means 37 is disposed to surround boss 263 and is comprised of a fixed ring 371 and a sliding ring 372. Fixed ring 371 is secured to an end surface of annular projection 112 of front end plate 11 by pins 373, one of which is shown in FIG. 1. Fixed ring 371 is provided with a pair of keyways **371*a* and 371*b* in an axial end surface facing orbiting scroll member 26. Sliding ring 372 is disposed in a hollow space between fixed ring 371 and circular plate 261 of orbiting scroll member 26. Sliding ring 372 is provided with a pair of keys 372*a* and 372*b* on the surface facing fixed ring 371, which are received in keyways 371*a* and 371*b*. Therefore, sliding ring 372 is slidable in the radial direction by the guide of keys 372*a* and 372*b* within keyways 371*a* and 371*b*. Sliding ring 372 is also provided with a pair of keys 372*c* and 372*d* on its opposite surface. Keys 372*c* and 372*d* are arranged along a diameter perpendicular to the diameter along which keys 372*a* and 372*b* are arranged. Circular plate 261 of orbiting scroll member 26 is provided with a pair of keyways (in FIG. 6 only one of keyways 261*a* is shown, the other keyway is disposed dimetrically opposite to keyway 261*a*) on a surface facing sliding ring 272 in which are received keys 372*c* and 372*d*. Therefore, orbiting scroll member 26 is slidable in a radial direction by guide of keys 372*c* and 372*d* within the keyways of circular plate 261**.

Accordingly, orbiting scroll member 26 is slidable in one radial direction with sliding ring 372, and is slidable in another radial direction independently. The second sliding direction is perpendicular to the first radial direction. Therefore, orbiting scroll member 26 is prevented from rotating, but is permitted to move in two radial directions perpendicular to one another.

In addition, sliding ring 372 is provided with a plurality of pockets or holes 38 which are formed in an axial direction. A bearing means, such as balls 39, each having a diameter which is longer than the thickness of sliding ring 372, are retained in pockets 38. Balls 39 contact and roll on the surface of fixed ring 371 and circular plate 261. Therefore, the axial thrust load from orbiting scroll member 26 is supported on fixed ring 371 through bearing means 39.

With the above driving support mechanism, the drive shaft is supported by the two bearing means, with one of the bearing means disposed in the sleeve portion of the front end plate member. Therefore, the drive shaft is supported by a long axial distance between the two bearing means. Thereby, the drive shaft is securely supported without motion or oscillation of the shaft off of its intended axis, and the load acting on the bearing means is reduced. If the load acting on the bearing means is reduced, the shaft supporting bearing means can be relatively small, whereby the diameter of the sleeve portion which is connected to the bearing means is reduced, and the diameter of the pulley of the clutch is reduced. Whereby the compressor can be driven by a high drive ratio. With the diameter of the sleeve portion and the pully of the clutch reduced, the compressor unit is simple in construction and light in weight.

The invention has been described in detail in connection with preferred embodiments, but these are examples only and this invention is not restricted thereto. It will be easily understood by those skilled in the art that other variations and modifications can be easily made within the scope of this invention.

We claim:

1. In an orbiting piston type fluid displacement apparatus including a housing having a front end plate member, a fixed member fixedly disposed relative to said housing, an orbiting piston member disposed within said housing and interfitting with said fixed member to make it least one line contact to define a sealed off fluid pocket, and a drive shaft which penetrates said front end plate member and is rotatably supported by said front end plate member through two bearings, said drive shaft being connected to said orbiting piston member to effect the orbital motion of said orbiting piston member, the improvement comprising said front end plate member including a front end plate portion and a separately formed annular sleeve portion, said front end plate portion being formed with an opening through which said drive shaft extends, and said annular sleeve portion being fixed to and extending from a front end surface of said front end plate portion for surrounding said drive shaft, said front end plate portion having a major dimension transverse to the axis of said drive shaft and a minor dimension along the axis of said drive shaft with said major dimension being substantially greater than said minor dimension, said annular sleeve portion having a hollow space which forms a continuation of the opening formed in said front end plate portion, a shaft seal assembly assembled on said drive shaft within said opening in said front end plate portion, said drive shaft being rotatably supported by said two bearings, which are disposed within said housing, and one of said bearings being disposed axially outward of said shaft seal assembly in said separate annular sleeve portion and the other of said bearings being disposed inward of said shaft seal assembly in said front end plate portion.

2. The improvement as claimed in claim 1, wherein said axially outward disposed bearing means is comprised of an enclosed and sealed grease bearing.

3. The improvement as claimed in claim 1, wherein an oil absorption member is disposed within the hollow space of said sleeve portion.

4. The improvement as claimed in claim 1, wherein a hole is connected to the hollow space and extends radially of said sleeve portion for allowing the escape of leaked oil.

5. The improvement as claimed in claim 1, wherein said front end plate portion is formed of aluminum material and said sleeve portion is formed of steel.

6. The improvement as claimed in claim 1, wherein a pulley is rotatably supported by a bearing which is disposed on the outer surface of said sleeve portion, an armature plate is elastically supported on the outer end of said drive shaft which is extends from said sleeve portion, and a magnetic annular coil is fixed to the outer surface of sleeve portion.

7. A scroll-type fluid displacement apparatus comprising:

a housing having a front end plate member;

a drive shaft;

said front end plate member comprising a front end plate portion in which is formed an opening through which said drive shaft extends, and an annular sleeve portion extending from a front end surface of said front end plate portion and surrounding said drive shaft, said annular sleeve portion being formed separately of said front end plate portion and being fixed on a front end surface of said front end plate portion, said front end plate portion having a major dimension transverse to the axis of said drive shaft and a minor dimension along the axis of said drive shaft with said major dimension being substantially greater than the minor dimension;

a fixed scroll member fixedly disposed relative to said housing and having an end surface from which a first wrap extends into the interior of said housing;

an orbiting scroll member having an end plate from which a second wrap extends, and said first and second wraps interfitting at an angular offset to make a plurality of line contacts to define at least one pair of sealed off fluid pockets;

driving means including said drive shaft extending through said front end plate member and rotatably supported thereby for effecting the orbital motion of said orbiting scroll member by the rotation of said drive shaft whereby said fluid pockets change volume by the orbital motion of said orbiting scroll member;

a shaft seal assembly assembled on said drive shaft within an opening in said front end plate portion;

two bearings for rotatably supporting said drive shaft, one of said bearings being disposed within said sleeve portion and outwardly of said shaft seal assembly and the other of said bearings being disposed within said front end plate portion and inwardly of said shaft seal assembly.

8. The apparatus as claimed in claim 7 wherein said front end plate portion is formed of aluminum material, and said sleeve portion is formed of steel material.

* * * * *